US006508310B1

(12) United States Patent
Mioduszewski et al.

(10) Patent No.: US 6,508,310 B1
(45) Date of Patent: Jan. 21, 2003

(54) BLADDER-TYPE SAMPLING PUMP CONTROLLER

(75) Inventors: David Mioduszewski, Ann Arbor, MI (US); David A. Fischer, Ann Arbor, MI (US); David B. Kaminski, Clayton, CA (US)

(73) Assignee: QED Environmental Systems, Inc., Ann Arbor, MI (US)

( * ) Notice: Subject to any disclaimer, the term of this patent is extended or adjusted under 35 U.S.C. 154(b) by 14 days.

(21) Appl. No.: 09/661,176

(22) Filed: Sep. 13, 2000

(51) Int. Cl.[7] ..... F21B 34/06; F21B 43/00; F21B 49/00; F04F 1/00

(52) U.S. Cl. ..... 166/373; 166/64; 166/105; 166/250.15; 166/264; 417/120; 417/138

(58) Field of Search ..... 166/64, 105, 142, 166/250.15, 264, 373; 417/86, 118, 120, 137, 138, 437, 474, 478

(56) References Cited

U.S. PATENT DOCUMENTS 4,489,779 A * 12/1984 Dicksinson et al. ..... 166/64
4,585,060 A * 4/1986 Bernardin et al. ..... 166/64
4,701,107 A * 10/1987 Dickinson et al. ..... 417/86

(List continued on next page.)

OTHER PUBLICATIONS

MicoPurge® basics™ Products, date unknown.*

Trademark Electronic Search System, "Micro Purge", trademark registered Nov. 7, 1995.*

Engineering Specification: Ground–water Sampling Pump Controller Specification, QED Sample Engineering Specificaiton, Apr. 24, 2001.*

"MP 10 Controller User's Guide", Mar. 1, 2001.*

"MP 15 Controller and Power Pack User's Guide", Jun. 1, 2000.*

Low–Flow Purging Reduces Management of Contaiminated Groundwater, Dec. 1995.*

"User's Guide" published prior to filing date of Sep. 13, 2000.

Paper entitled "Model 6000 Static Water Level Meter" dated Jun. 16, 1992.

"Electronic Programmable Controller Model 400" published prior to filing date of Sep. 13, 2000.

"FC 5000 Flow Cell Meter & Sonde Quickguide" published Oct. 20, 1999.

Information Sheet "Low Flow Ground Water Sampling" issued Jun. 1996 from the Maine Department of Environmental Protection.

(List continued on next page.)

*Primary Examiner*—David Bagnell
*Assistant Examiner*—Jennifer H Gay
(74) *Attorney, Agent, or Firm*—Harness, Dickey & Pierce, PLC

(57) ABSTRACT

A method for using a controller to control a fluid pump by controlling the rate at which the pump fills with fluid and subsequently discharges fluid. The pump includes a chamber for collecting fluid from within a well bore in which the pump is disposed. A user inputs a pump cycle time and a pump cycle volume to the controller. The pump cycle time input is used to determine a cycling period for the pump. The pump cycle volume is used to allot a portion of the cycling period to the refilling of the pump with fluid and the remaining portion of the cycling period to the discharging of fluid from the pump. The controller controls the pump such that the pump is vented to atmosphere during the refill portion, allowing the pump to fill with fluid, and such that pressurized fluid, such as compressed gas, is injected into the pump during the discharge cycle, causing fluid collected within the pump to be discharged. In another mode of operation, a sensor is coupled to the controller. The sensor sense when the water level in the well bore drops below a maximum desired drawdown level, and the controller adjusts the pumping rate to avoid exceeding the maximum drawdown level.

20 Claims, 4 Drawing Sheets

U.S. PATENT DOCUMENTS 4,886,432 A * 12/1989 Kimberlin ..... 417/478
4,974,674 A * 12/1990 Wells ..... 166/107
5,027,902 A * 7/1991 Dickinson et al. ..... 166/369
5,147,185 A * 9/1992 Niehaus et al. ..... 417/394
RE34,754 E * 10/1994 Dickinson et al. ..... 166/64
5,611,671 A * 3/1997 Tripp, Jr. ..... 417/126
6,021,664 A * 2/2000 Granato et al. ..... 73/53.01
6,224,343 B1 * 5/2001 Newcomer ..... 417/118

OTHER PUBLICATIONS

EPA Ground Water Issue Low–Flow (Minimal Drawdown) Ground–Water Sampling Procedures issued Dec. 1995 from U.S. Environmental Protection Agency.

* cited by examiner

BLADDER-TYPE SAMPLING PUMP CONTROLLER

BACKGROUND OF THE INVENTION

1. Technical Field

This invention relates to controllers for groundwater sampling pumps, and more particularly to an electrical controller which controls the timing and duration of the injection of compressed air into a bladder within a bladder pump and the subsequent venting of the compressed gas in order control the rate at which fluid is pumped by the bladder pump.

2. Background Art

Fluid pumps such as bladder pumps are commonly used in the sampling of groundwater. A bladder pump commonly consists of a housing which forms a chamber, inside of which is an inflatable bladder. When the bladder is filled with compressed gas, fluid admitted to the housing inside the chamber is forced (i.e. squeezed) by the bladder up through a discharge tube within the housing and discharged from the top of the discharge tube. When the bladder is subsequently vented, the chamber is refilled as fluid from the ground is admitted into the chamber through a one-way valve at a bottom fluid inlet of the pump and held within the chamber until the bladder is again filled with compressed gas and the fluid is discharged. A complete pump cycle therefore includes a refill and a discharge operation. Normal pump operation generally includes a series of the above-described pump cycles.

Bladder pumps have conventionally been controlled by setting the timing for a refill and corresponding discharge cycle. The timing used is generally dependent on the characteristics of the pump, the characteristics of the well, and the objectives to be obtained in operating the pump. For instance, longer periods of injecting compressed air into the bladder are required to lift fluid up through the chamber for greater depths. Similarly, longer periods of venting of the bladder are required for pumps which are submerged to a lesser distance below the water level in the well bore, than for pumps that are located deep within a well bore, or in situations requiring more time to allow the chamber to refill to its full liquid displacement volume.

Furthermore, in recent years, new methods of sampling ground water have come into broader practice. These methods relate primarily to operating the sampling pump at controlled, lower flow rates, so as to provide more accurate samples and produce less purge water. Achieving and reproducing these more precise lower flow rates requires additional skill and care by the operator.

An additional concern in the art of sampling groundwater is excessive drawdown in the well bore. It is important in sampling groundwater with a pump to avoid pumping the water level down to excessive drawdown levels. Otherwise, sample integrity can be compromised. Taking drawdown into account adds another layer of complexity to controlling groundwater sampling pumps.

As a result of this variability in setting and controlling the cycle timing of bladder pumps, conventional methods of pump cycle timing have been difficult to learn and effectively use for some operators. Traditional controllers are operated by manually setting the refill and discharge times to achieve a desired volume per cycle. These adjustments have proven to be complex and difficult for inexperienced pump operators and technicians to master.

Accordingly, it is a principal object of this invention to provide a controller for achieving low, controlled flow rates with fluid pumps, which is easier for experienced and inexperienced operators to adjust than previously available pump controllers. It is an additional purpose of this invention to provide a controller which can be more easily set to control the cycling of a fluid pump to provide an effective means of limiting the amount of water drawdown created in a well in which the pump is disposed.

SUMMARY OF THE INVENTION

The above and other objects are provided by a pump controller and method in accordance with preferred embodiments of the present invention.

The method of the present invention includes controlling a cycle time of a pump, such as a well known bladder pump. Additionally, for a given cycle time, the method of the present invention includes controlling the volume of a fluid discharged per cycle by controlling the time within the cycle during which the pump is filled with a compressed fluid such as compressed gas, and subsequently the time allowed for the gas to be vented to the atmosphere. The cycle time, the time during which the pump is filled with compressed gas, and the subsequent time during which the gas is vented from the pump are controlled in response to a user input. It is a principal feature of the controller that these operating parameters can be easily set and modified even by relatively inexperienced technicians or other individuals to achieve desired fluid flow rates.

When the user wishes to increase the volume of the fluid discharged by the pump for a given cycle time, the user causes the controller to generate a signal increasing the time during which the pump discharges fluid, and decreases the time during which the pump refills. The result is a longer period of time during which the pump is filled with compressed air and a shorter period during which the pump is vented. When the user wishes to decrease the volume of the fluid discharged by the pump for a given cycle time, the user causes the controller to generate a signal decreasing the time during which the pump discharges fluid, and increases the time during which the pump refills. The result is a shorter period of time during which the pump is filled with compressed air and a longer period during which the pump is vented. Increasing or decreasing the total amount of fluid discharged by the pump is achieved by adjusting both the cycle time and the fluid volume discharged per cycle simultaneously.

In one embodiment of the present invention, the user interacts with the controller through the use of a control knob or dial and a cycle time input. The control knob is turned in one direction to increase the volume discharged per cycle. The control knob is turned in the opposite direction to decrease the volume discharged per cycle. The cycle time input is used to increase or decrease the cycle time. In another embodiment of the present invention, the user interacts with the controller through the use of an increase-decrease arrow key set and a cycle time input. Pressing an "increase" button increases the volume discharged per cycle and pressing a "decrease" button decreases the volume discharged per cycle. Again, the cycle time input is used to increase or decrease the cycle time.

It is another object of the present invention to provide a controller that temporarily slows or stops pump operation if well drawdown limits are exceeded. To accomplish this, the present invention uses a sensor or probe in communication with the controller to sense the water level. The sensor generates a signal indicating water detection when it makes contact with the water, and correspondingly, stops generating a signal when the sensor is no longer in contact with the water. This signal is propagated to the controller. The controller then adjusts the operation of the pump in response to this signal.

In one mode of operation of the present invention, the controller slows or stops the pump operation in response to a signal indicating that the water level has dropped below the level of the probe. In this mode of operation, the pump remains in the refill mode until the water level rises to the level of the probe. The controller then instructs the pump to resume normal operation in response to a signal indicating that the water level has risen to the level of the probe. In another preferred embodiment, the controller causes the pump to stop and remain inactive for a set period of time in response to a signal that the water level is below the level of the probe. This time delay eliminates a high frequency "chatter" that can occur if the state of the water level is such that the signal from the probe repeatedly turns the pump off and on.

In one preferred embodiment of the present invention, the sensor is a conductance probe attached to the end of a measuring tape, which includes wiring for propagating a signal from the probe to the controller. This type of tape is commonly used in the ground water sampling field and includes a hand held revolving reel to store the tape. In conventional use, the probe is lowered into the well. When the probe makes contact with water, the electrical circuitry of the probe senses electrical conductance through the water and propagates a signal to the controller. The probe can also be set to sense an absence of electrical conductance, indicating that the probe is above the water level. In use, the probe is first used to sense the water level in the manner conventionally practiced. The probe is then switched to sense a lack of conductance through water, which allows it to propagate a signal to the controller when the drawdown level is too low. The controller then stops or slows the pump until the water level rises.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
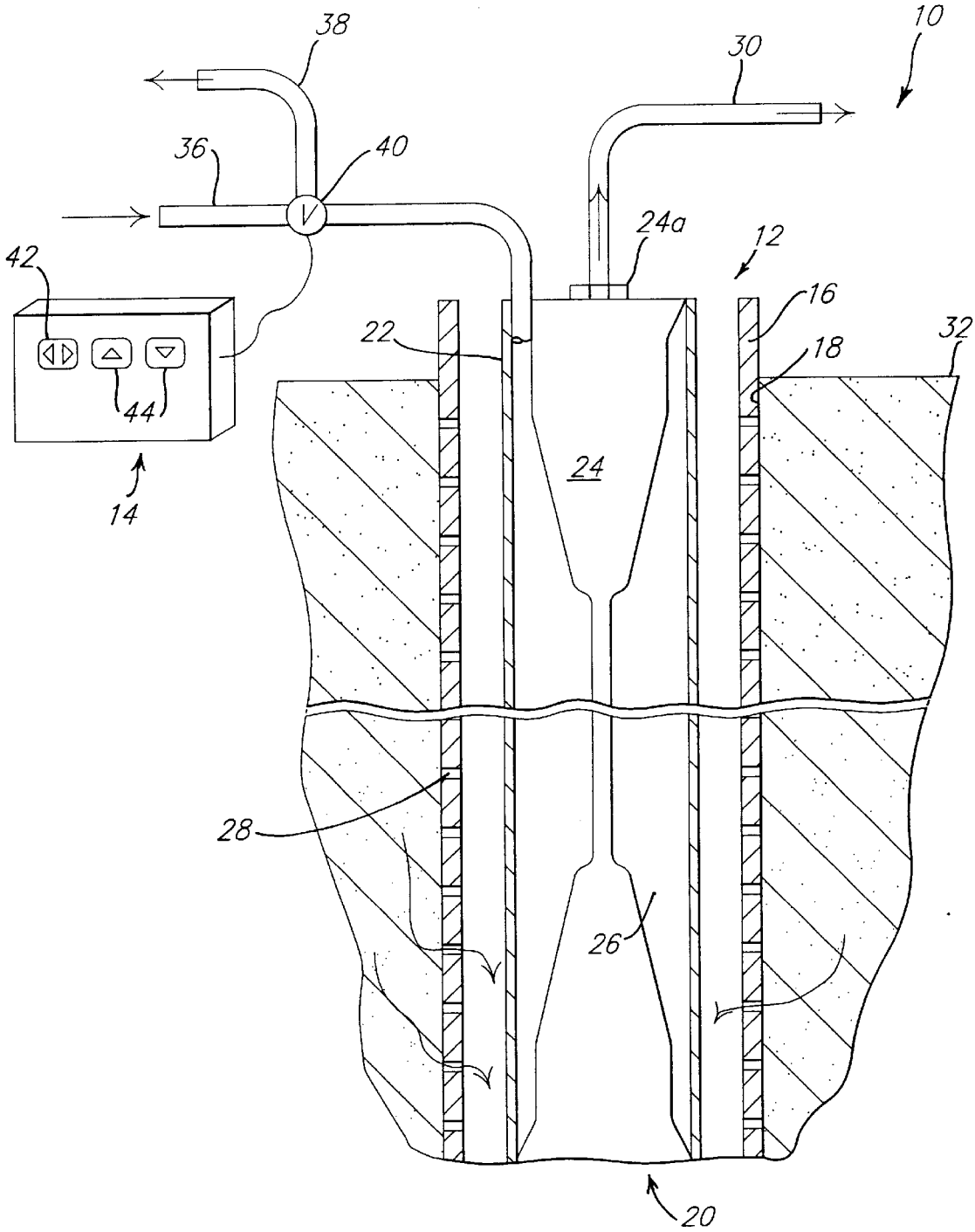
FIG. 1 is a cross-sectional view of a prior art bladder pump in accordance with the teachings of a preferred embodiment positioned within a well bore, and controlled by a controller of the present invention having a user interface.

Referring to FIG. 1, there is shown a system 10 comprised of a bladder pump system 12 and a controller in the form of a control module 14, in accordance with a preferred embodiment of the present invention.

The bladder pump system 12 is well known in the art and includes a well casing 16 which is inserted into a well bore 18, and a bladder pump 20 which is lowered into the well casing. While a bladder pump 20 is illustrated, it will be appreciated that the present invention is not limited strictly to bladder pumps, but instead could be implemented with other forms of pumps. In a preferred embodiment of the present invention, the controller 14 is a portable controller and the bladder pump 20 is a portable bladder pump.

The bladder pump 20 includes an outer housing 22 which defines a chamber 24, and a flexible tubular bladder 26 disposed within the outer housing 22. Fluid is allowed to flow into the area defined by the well casing 16 though a grid of holes 28 in the well casing. The fluid then collects in the chamber 24, entering through the bottom of the chamber 24. A one way valve, such as a checkball valve (not shown), allows the fluid to enter the chamber 24 but does not allow it to flow in the opposite direction out of the chamber 24. The water is subsequently discharged through a tube 30 coupled to an outlet 24*a* at the top of the chamber 24 and terminating at a point, above ground level 32, where the fluid can be discharged to a reservoir (not shown).

In normal operation, the bladder pump 20 discharges the fluid collected within the chamber 24 when the bladder 26 is squeezed by a compressed fluid, such as compressed gas. In one preferred embodiment, the compressed gas is carbon dioxide ($CO_2$). The compressed gas is forced by a compressor 34 (shown in FIG. 3) into the bladder 26 through an inlet tube 36 which causes the bladder 26 to be collapsed or squeezed, which in turn forces the fluid in the chamber 24 upwardly out through the tube 30 at the top of the chamber 24. The fluid is allowed to collect in the chamber 24 when the bladder 26 is vented to the atmosphere. The bladder 26 is vented through a vent tube 38. The position of a valve 40 determines whether compressed air is forced into the bladder 26 or is vented from the bladder 26.

In one embodiment of the present invention, the position of the valve 40 is determined by the controller 14. The user sets the controller 14 to actuate the valve 40 so as to achieve a desired pump rate by interfacing with a cycle time button 42 and a set of increase-decrease arrow keys 44 for controlling the fluid volume discharged per cycle by the pump 20. One skilled in the art will recognize that the button 42 and key set 44 could each be replaced by any of a number of interface devices. For instance, the increase-decrease arrow key set 44 could be replaced by a rotatable dial or knob.

Figure 2:
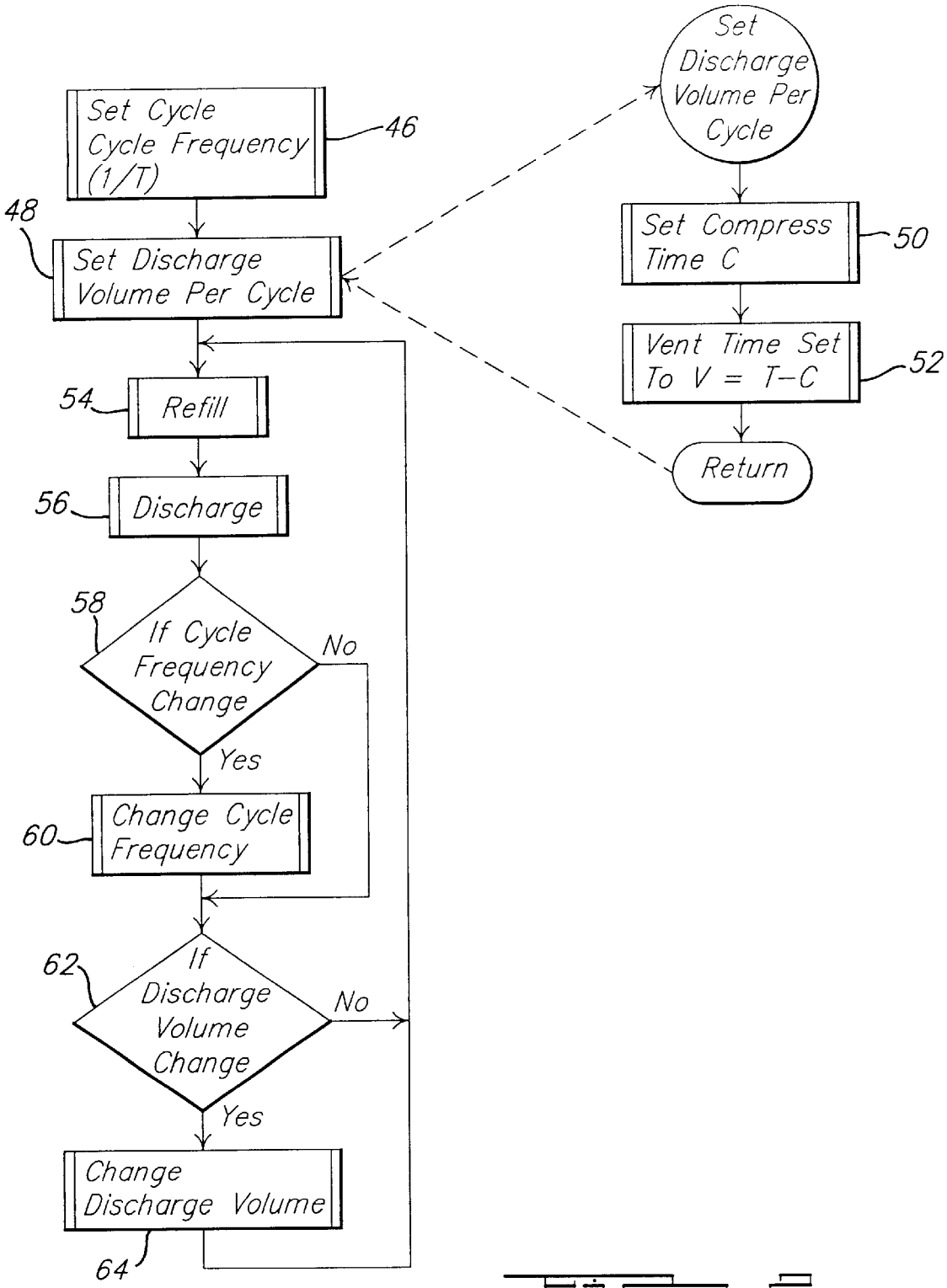
FIG. 2 is a flowchart of a method of controlling a bladder pump in accordance with the teachings of the present invention.

With reference to FIG. 2, a method of controlling a bladder pump in accordance with the teachings of the present invention includes the following steps. The user begins by selecting a cycle time, as indicated at step 46, appropriate for the depth of the pump and the level of the fluid to be pumped. The cycle time is set by actuation of the cycle time button 42 of the controller 14. The user proceeds by setting the volume of fluid discharged during each cycle of the pump, as indicated by step 48, by actuation of the volume per cycle arrow key set 44. Setting the volume per cycle includes the steps of setting the amount of time, as shown at step 50, during which compressed gas is forced into the bladder 26. The amount of time, as indicated at step 52, that the bladder 26 is vented is then automatically set to be the difference between the total cycle time set in step 46 and the amount of time compressed gas is forced, as set in step 50. By setting the cycle time and the discharge volume per cycle, a specific fluid flow rate can be achieved. That fluid flow rate is the number of cycles per minute (CPM: equal to 60 seconds divided by cycle time in seconds) multiplied by the fluid volume discharged per cycle. For example, for a cycle time of 15 seconds, which equates to a CPM of 4, and a volume of 60 ml discharged per cycle, the flow rate would be 4×60 ml=240 ml per minute.

When the flow rate has been set, the controller 14 instructs the pump to refill with fluid, as indicated at step 54. The controller 14 does this by setting the valve 40 to the vent position for the portion of the cycle set in step 52. As the compressed gas is vented out of the bladder 26 the bladder is allowed to expand, thus allowing fluid to again to be drawn in through the one-way check valve at the bottom of the chamber 24. After the expiration of the time set in step 52, the controller 14 again causes the pump to discharge fluid, as indicated at step 56. The controller 14 does this by setting the valve 40 to the compress gas position for the portion of the cycle time allotted in step 50, allowing compressed air from the compressor 34 to be injected into the bladder 26 through the inlet tube 36. When the bladder 26 is collapsed or constricted by compressed air, the effective volume of the chamber 24 is reduced, forcing the fluid out the top of the chamber through the discharge tube 30.

During normal pump operation, the user can change the cycle time and volume per cycle parameters by the actuation of the cycle time button 42 and the volume per cycle arrow key set 44 respectively. The procedure is the same as that described for steps 46–52. With further reference to FIG. 2, if the user elects to change the cycle time, as indicated at step 58, by pressing the cycle time button 42, the cycle time is changed, as indicated in step 60, the same as in step 46. If the user elects to change the volume per cycle, as indicated at step 62, by actuating the volume per cycle arrow key set 44, the volume is changed, as indicated in step 64, the same as in steps 48–52. The controller 14 implements these changes at the beginning of the next refill portion of the cycle, as indicated at step 54. The pump continues to alternate between the refill portion of the cycle 54 and the discharge portion of the cycle, as indicated at step 56, until further changes are made as in steps 58–64, or pump operation is ceased.

Figure 3:
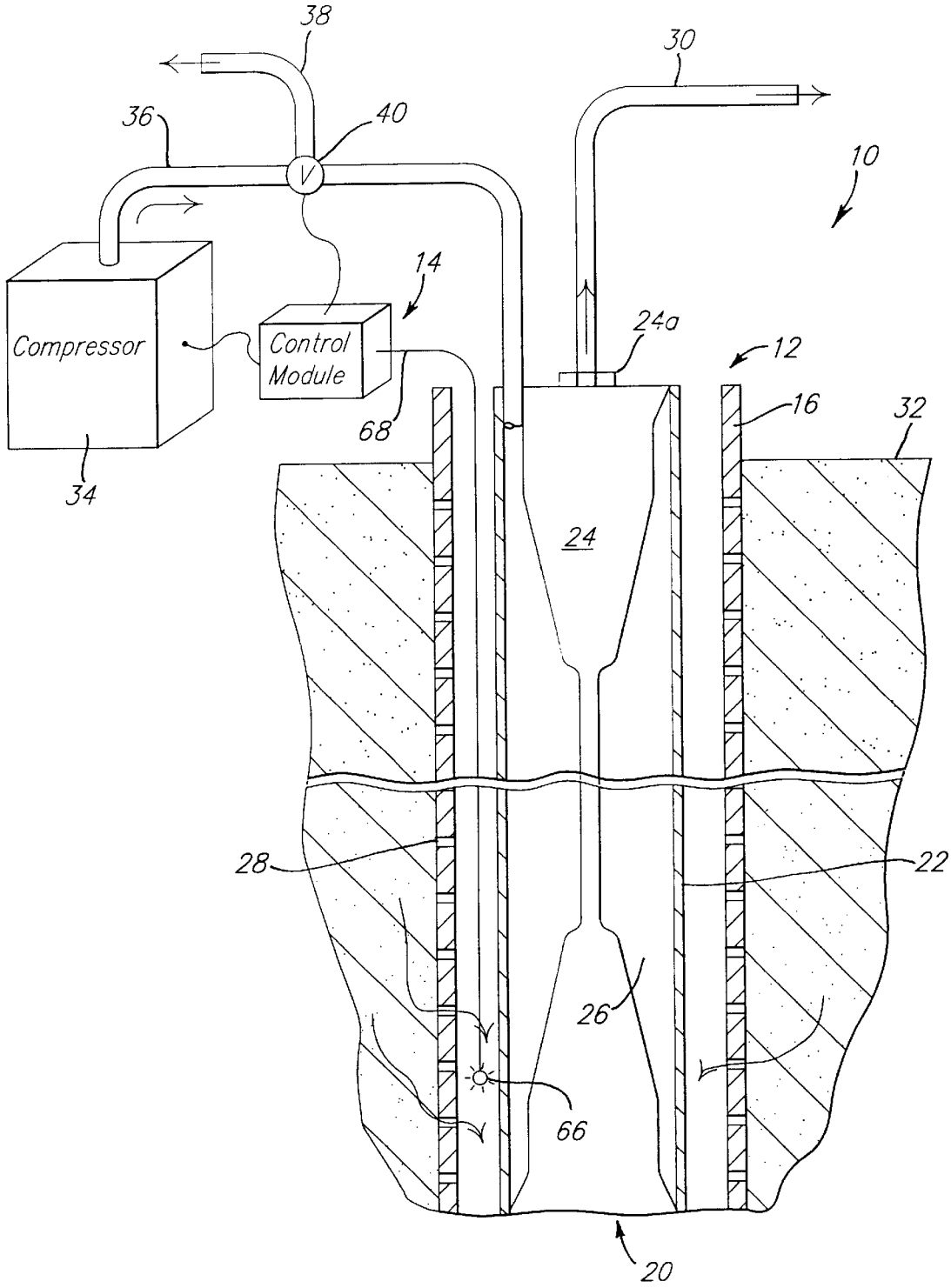
FIG. 3 is a cross-sectional view of a prior art bladder pump being used with a water level sensor connected to a controller of the present invention.

In another preferred embodiment of the present invention, the pump 20 is slowed or stopped when the water level in the well bore 18 drops below a threshold level. This prevents excessive drawdown. It is important in groundwater sampling to limit drawdown, as this will limit the differential head driving flow into the well and limit the velocity of the water flowing into the well. With reference to FIG. 3, the position of the valve 40 is determined by the controller 14. The controller 14 controls the position of the valve 40 and the operation of the compressor 34 in response to signals from a water level sensor 66. The sensor 66 detects the level of the fluid in the well bore 18 and transmits a signal representing this information to the controller 14. When the water level drops below a given threshold level, the controller 14 slows or stops operation of the pump 20. Alternately, the pump 20 can be set to remain in the refill state until the fluid level rises above the predetermined threshold level.

In one embodiment of the present invention, the sensor 66 is a probe attached to a measuring tape 68 that contains a wire. The sensor 66 senses the conductivity of water when it makes contact with water. Alternately, the sensor 66 could sense an absence of conductivity, such as when no water is present. The signal from the sensor 66 is carried through the wire in the tape 68 to the controller 14. A probe attached to a tape is only one example of a sensor arrangement, and those skilled in the art will recognize that various other such sensor arrangements can be used to sense the water level in the well bore 18. Some examples of other sensor techniques common in the art are measuring bubbler tube backpressure, hydrostatic water pressure, and ultrasonic or refractive indexing.

Figure 4:
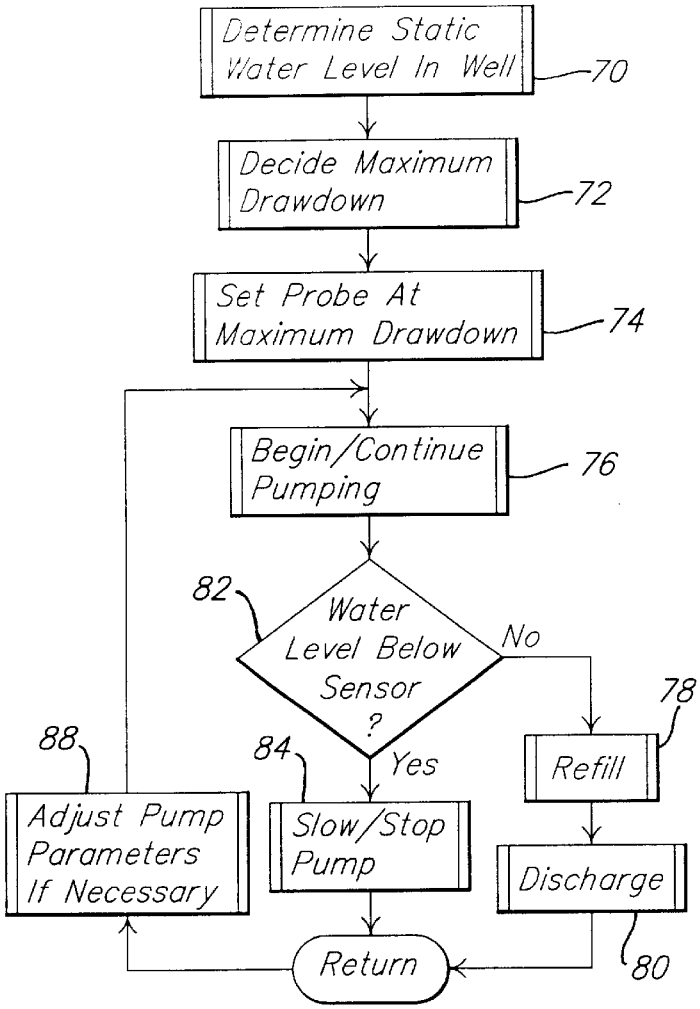
FIG. 4 is a flowchart of a preferred method of controlling a bladder pump in accordance with the present invention with the assistance of a water level sensor.

With reference to FIG. 4, a method of controlling a bladder pump in accordance with the teachings of the present invention includes the following steps. The user of the pumping system 10 first determines a static water level in the well bore 18, as indicated in step 70. In one embodiment of the present invention, the static water level is measured by a conventional means that includes lowering the sensor 66 attached to the measuring tape 68 into the well bore 18. The sensor 66 is set to sense conductivity through water. When the sensor makes contact with water, an electrical signal is sent through wires in the tape 68, which causes a device (not shown) at the ground surface 32 to emit an audible or visible alarm. The user then reads markings on the measuring tape 68, which represent the depth that the sensor 66 has been lowered, to determine the static level of the water in the well bore 18. The preceding procedure for measuring the static water level in a well bore is merely exemplary, and those skilled in the art will recognize that other means of measuring the static water level are within the scope of the present invention.

Once the user determines the static water level in the well bore 18, the user decides what the maximum desired drawdown level is, as indicated at step 72. This is determined by the user based on well characteristics and pumping purpose. Once the maximum drawdown level is decided, the user lowers the sensor 66 to the maximum drawdown level, as indicated at step 74. The sensor 66 and the controller 14 are then reconfigured to sense an absence of water. The user then begins normal pump operation, as indicated at step 76.

With further reference to FIG. 4, the normal pump operation of step 76 preferably includes the steps of the steps of checking the water level, as indicated at step 82, refilling, as indicated at step 78, the chamber 24 of the pump 20 with water by venting compressed air from the bladder 26, and subsequently discharging, as indicated at step 80, the water from the chamber 24 of the pump 20 by injecting compressed air into the bladder 26. If the water level drops below the sensor 66, the sensor sends a signal to the controller 14 informing the controller 14 that the water has dropped below the maximum drawdown level, as indicated by step 82. The controller 14 then slows or stops pump operation, as indicated at step 84, until the water level rises above the maximum desired drawdown level. In one mode of operation of the present invention, this is achieved by turning off the pump 12 until the water level rises above the maximum drawdown level. In another mode of operation, the controller 14 adjusts the cycle time, refill time, and discharge time parameters of the pump 20 to achieve a lower flow rate.

Figure 5:
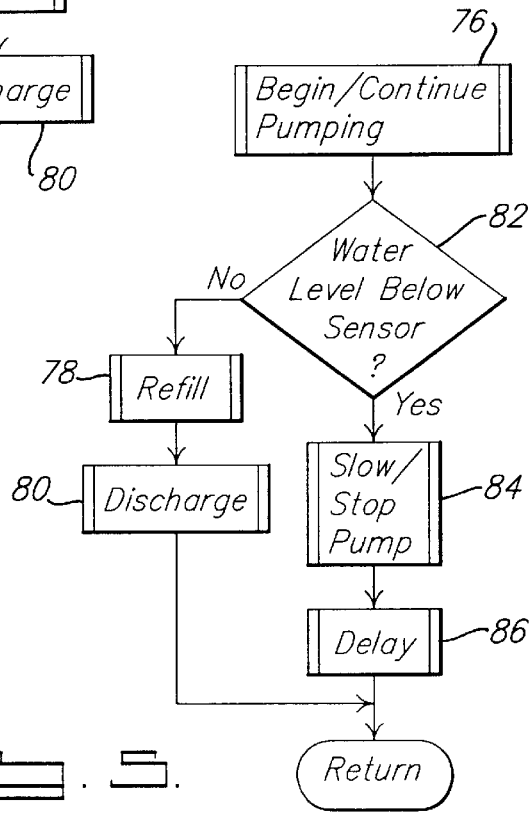
FIG. 5 is a flowchart of an alternative preferred method of controlling a bladder pump of FIG. 4 in accordance with the present invention.

With reference to FIG. 5, in another alternative preferred method of operation of the present invention, when the sensor 66 detects that the water level has dropped below the sensor 66, the sensor 66 sends a signal to the controller 14 informing the controller 14 that the water has dropped below the maximum drawdown level, as indicated at step 82. The controller 14 then slows or stops pump operation, as indicated at step 84. It will be noted that steps 76–84 of FIG. 5 are the same as steps 76–84 of FIG. 4. The controller 14 then instructs the pump 20 to remain in the slowed or off state for a set period or delay, as indicated at step 86. This prevents the pump 20 from quickly turning on and off if the sensor 66 senses a water level that alternately rises above the maximum drawdown level and drops below the maximum drawdown level in relatively rapid fashion. The pump can then be adjusted as necessary as shown in FIG. 4, as indicated at step 88.

In another alternative preferred method of operation of the present invention, the pumping system 10 is controlled by the controller 14 which receives input from both the user and the sensor 66. With this method of operation, the user sets the maximum drawdown level of the well bore 18 as in steps 70–74 in FIG. 4, and observes the normal pump operation, as in steps 76–84 of FIG. 4, or alternately as in steps 76–86 of FIG. 5. If it appears to the user that pump 20 is being shut down or slowed down at an undesirable frequency, the user can adjust the flow rate of the pump 20 by adjusting the cycle time and discharge volume per cycle, as indicated at step 88, which is the same as FIG. 2, steps 46–52, described above.

The above-described control schemes have the important advantage that each can be implemented with a limited number of user controls on a controller module and adjusted quickly and easily to suit the specific needs of a variety of fluid pumping conditions and applications. The ease of adjustability of the controls also enables those individuals who do not possess the experience to accurately gauge or assess fluid flow conditions to easily modify controller settings to precisely tailor operation of a pump to meet a wide variety of pump conditions.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for using a controller to control a fluid pump, wherein the fluid pump is disposed in a well bore containing fluid, the method comprising the steps of:

inputting a pump cycle time to the controller;

inputting a pump cycle volume to the controller;

using the controller to determine, from the pump cycle time input and the pump cycle volume input, a cycling period divided into a refill time and a discharge time, the cycling period being equal to the sum of the refill and discharge times; and using the controller to control the pump such that the pump is vented to atmosphere during the refill period to allow filling of the pump with the fluid and the pump is supplied with a pressurized fluid during the discharge period to cause said fluid collected within the pump to be discharged from the pump.

2. The method of claim 1, wherein inputting the pump cycle volume to the controller includes using an increase-decrease arrow key set.

3. The method of claim 1, wherein inputting the pump cycle volume to the controller includes using a dial.

4. The method of claim 1, wherein inputting the pump cycle time includes using a button.

5. The method of claim 1, wherein the step of supplying the pump with a pressurized fluid includes using compressed gas.

6. The method of claim 5, wherein the compressed gas is carbon dioxide.

7. A method for controlling a fluid pump via a controller, the pump having a fluid chamber for collecting fluid therein when the pump is disposed in a well bore containing the fluid, the method comprising the steps of:

inputting a cycle time user input into the controller for specifying a total amount of time for the pump to refill and discharge;

inputting a cycle volume user input into the controller for specifying an amount of fluid to be drawn into the pump and subsequently discharged;

using the controller to determine, from the pump cycle time input and the pump cycle volume input, a cycling period divided into a refill time and a discharge time, the cycling period being equal to the sum of the refill and discharge times;

measuring a level of the fluid in the well bore using a sensor;

transmitting a signal from the sensor to the controller, wherein the signal contains information about the level of the fluid in the well bore relative to a threshold level; and wherein the controller controls the pump such that water is drawn into and subsequently discharged from the pump at a first pumping rate defined by the cycle time input and the cycle volume input while the fluid level is above the threshold, and the pump operates in a second pumping rate less than the first pumping rate when the fluid level is below the threshold.

8. The method of claim 7 wherein the step of using the fluid level sensor comprises the steps of:

lowering a tape into the well bore;

using a sensor attached to the bottom of the tape, said sensor sensing conductance through the fluid when the sensor makes contact with the fluid; and using a wire cable for communicating a signal from the sensor to the controller.

9. The method of claim 7, wherein the step of controlling the pump such that it operates in a second pumping rate includes stopping the pump.

10. The method of claim 7, further comprising the step where the pump remains at the second pumping rate for a predetermined period or delay.

11. The method of claim 7, further comprising the step of reconfiguring the controller and sensor to sense an absence of water.

12. An apparatus for controlling groundwater sampling rates, the apparatus comprising:

a pump;

a pump controller;

a cycle time user input for specifying a total amount of time for the pump to refill and discharge;

a cycle volume user input for specifying an amount of a fluid to be drawn into the pump and subsequently discharged; and using the pump controller to determine, from the pump cycle time input and the pump cycle volume input, a cycling period divided into a refill time and a discharge time, the cycling period being equal to the sum of the refill and discharge times.

13. The apparatus of claim 12, further comprising a sensor that senses a water level in the well bore, wherein the controller controls the pumping rate of the pump in response to a signal from the sensor.

14. A method of sampling groundwater using a fluid pump, the method comprised of the following steps:

inputting a cycle time user input into a controller for specifying a total amount of time for the pump to refill and discharge;

inputting a cycle volume user input into the controller for specifying an amount of fluid to be drawn into the pump and subsequently discharged;

using the controller to determine, from the pump cycle time input and the pump cycle volume input, a cycling period divided into a refill time and a discharge time, the cycling period being equal to the sum of the refill and discharge times;

determining a maximum drawdown level;

measuring a level of a fluid in a well bore using a sensor;

transmitting a signal from the sensor to the controller, wherein the signal contains information about the level of the fluid in the well bore relative to a threshold level;

controlling the pump such that fluid is drawn into a chamber in the pump from the ground and subsequently discharged from the chamber above ground level at a first pumping rate defined by the cycle time input and the cycle volume input; and controlling the pump such that the pump operates at the first pumping rate when the fluid level is above the threshold, and the pump operates at a second pumping rate less than the first pumping rate when the fluid level is below the threshold.

15. The method of claim 14, wherein the step of controlling the pump such that it operates at a second pumping rate includes stopping the pump.

16. The method of claim 14, further comprising the step where the pump remains at the second pumping rate for a predetermined period or delay.

17. The method of claim 14, wherein setting the flow rate includes the steps of:

inputting a pump cycle time to the controller;

inputting a pump cycle volume to the controller;

using the pump cycle time to determine a cycling period; and using the pump cycle volume to allot a portion of the cycling period to a refill time and a remaining portion of the cycling period to a discharge time, the cycling period being equal to the sum of the refill and discharge times.

18. The method of claim 17, further comprising the step of venting the pump during the refill period to allow filling of the pump with the fluid, and supplying the pump with a pressurized fluid during the discharge period to cause the fluid collected within the pump to be discharged from the pump.

19. The method of claim 18, wherein the pressurized fluid is carbon dioxide.

20. The method of claim 14, further comprising the step of using the sensor to sense an absence of fluid.

* * * * *